US011113902B2

(12) United States Patent
Pham et al.

(10) Patent No.: US 11,113,902 B2
(45) Date of Patent: Sep. 7, 2021

(54) ON BOARD DIAGNOSTICS DRIVE CYCLE ADVISOR

(71) Applicant: Innova Electronics Corporation, Irvine, CA (US)

(72) Inventors: Phuong Pham, Irvine, CA (US); Thuan Cong Huynh, Irvine, CA (US)

(73) Assignee: Innova Electronics Corporation, Irvine, CA (US)

( * ) Notice: Subject to any disclaimer, the term of this patent is extended or adjusted under 35 U.S.C. 154(b) by 227 days.

(21) Appl. No.: 16/391,519

(22) Filed: Apr. 23, 2019

(65) Prior Publication Data

US 2020/0342694 A1 Oct. 29, 2020

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01); *G07C 5/085* (2013.01)

(58) Field of Classification Search
CPC ..... G07C 5/0808; G07C 5/008; G07C 5/085
USPC ..... 701/29.2
See application file for complete search history.

(56) References Cited

U.S. PATENT DOCUMENTS 6,157,878 A * 12/2000 Suzuki ..... G01M 17/0072 701/31.6
6,879,894 B1 * 4/2005 Lightner ..... G07C 5/008 701/31.4
8,600,610 B2 12/2013 Bertosa et al.
8,811,008 B2 8/2014 Selkirk et al.
9,183,681 B2 11/2015 Fish
D745,029 S 12/2015 Gray et al.
D746,316 S 12/2015 Gray et al.
D746,323 S 12/2015 Gray et al.
9,213,332 B2 12/2015 Fish et al.
D747,734 S 1/2016 Gray et al.
D749,623 S 2/2016 Gray et al.
9,262,254 B2 2/2016 Bertosa et al.
9,292,977 B2 3/2016 Bertosa et al.
D757,059 S 5/2016 Gray et al.
9,329,633 B2 5/2016 Selkirk et al.
D770,462 S 11/2016 Gray et al.
9,858,731 B2 1/2018 Fish et al.
(Continued)

*Primary Examiner* — Gertrude Arthur Jeanglaude
(74) *Attorney, Agent, or Firm* — Stetina Brunda Garred & Brucker

(57) ABSTRACT

Provided is a method of completing an incomplete drive cycle test on a vehicle resulting from an incomplete vehicle monitoring process. The method includes establishing a communication link between a portable electronic device and a vehicle computer, and receiving initial diagnostic data from the vehicle computer using the portable electronic device. The initial diagnostic data is analyzed to identify the incomplete vehicle monitoring process and a driving procedure for resetting an incomplete vehicle monitor associated with the incomplete vehicle monitoring process. Live data is received from the vehicle computer while the vehicle is in motion to track progression through the driving procedure. The method may include receiving subsequent diagnostic data from the vehicle while the vehicle is in motion. The subsequent diagnostic data is analyzed while the vehicle is in motion to determine if the status of the incomplete vehicle monitoring process transitions to complete.

20 Claims, 6 Drawing Sheets

(56) References Cited

U.S. PATENT DOCUMENTS

| | | | | |
|---|---|---|---|---|
| 9,904,634 | B2 | 2/2018 | Case, Jr. et al. | |
| 10,295,333 | B2 | 5/2019 | Fish et al. | |
| 10,467,906 | B2 | 11/2019 | Fish et al. | |
| 2010/0023292 | A1* | 1/2010 | Willard | G07C 5/08 702/89 |
| 2017/0186054 | A1 | 6/2017 | Fish et al. | |
| 2018/0101775 | A1 | 4/2018 | Fish | |

* cited by examiner

28

| MONITOR 1 | PRECONDITION 1 | PROCEDURE 1 |
|---|---|---|
| MONITOR 2 | N/A | PROCEDURE 2 |
| ⋮ | ⋮ | ⋮ |
| MONITOR N | PRECONDITION N | PROCEDURE N |

ON BOARD DIAGNOSTICS DRIVE CYCLE ADVISOR

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to vehicle diagnostics, and more specifically, to a system and related methodologies for identifying incomplete vehicle monitors and providing assistance to a user for completing a driving procedure required for complete the vehicle monitor.

2. Description of the Related Art

Modern vehicles typically include several electronic sensors and systems associated with various aspects of vehicle operation. The sophistication of modern vehicles has allowed for self-diagnostic and reporting capabilities. For instance, the automotive industry has adopted a self-reporting diagnostic standard commonly referred to as OBD-II (e.g., on-board diagnostics II), which may monitor operation of various emission-related components and systems. To that end, the vehicle may include an on-board computer, e.g., an electronic control unit (ECU), which may incorporate a diagnostic program comprised of various test procedures and diagnostic strategies.

Some of the diagnostic functionalities performed on the vehicle include readiness monitors, which may include self check routines. In generally, there are two different types of readiness monitors: continuous monitors and non-continuous monitors. Continuous monitors may be constantly tested and evaluated while the engine is running, while non-continuous monitors may require certain conditions be met before completing a test.

Each readiness monitor may be associated with a monitor status, such as complete (e.g., ready) or incomplete (e.g., not ready). A complete monitor status may indicate that the OBD-II system associated with the monitor has passed the associated test. Conversely, an incomplete monitor status may indicate that the associated test has not been completed. In order for a vehicle to be ready for an OBD test, the vehicle needs to reset the monitors by proceeding through a drive cycle.

Many vehicles do not provide a visual display of the readiness monitors status, nor do the vehicles provide the associated drive cycle requirements for completing any incomplete readiness monitors. As such, there may be difficulty in completing the drive cycle.

Accordingly, there is a need in the art for a system and method of identifying incomplete vehicle monitors and providing guidance to a user. Various aspects of the present disclosure address this particular need, as will be discussed in more detail below.

BRIEF SUMMARY

In accordance with one embodiment of the present disclosure, there is provided a method of completing an incomplete drive cycle test on a vehicle resulting from an incomplete vehicle monitoring process for testing the operation of a vehicle operating system. The method includes establishing a communication link between a portable electronic device and a vehicle computer, and receiving initial diagnostic data from the vehicle computer using the portable electronic device. The method further includes analyzing the initial diagnostic data to identify the incomplete vehicle monitoring process and a driving procedure for resetting an incomplete vehicle monitor associated with the incomplete vehicle monitoring process. The method additionally comprises receiving live data from the vehicle computer while the vehicle is in motion using the portable electronic device to track progression of the vehicle through the driving procedure. The method may further include receiving subsequent diagnostic data from the vehicle computer while the vehicle is in motion using the portable electronic device. The method also includes analyzing the subsequent diagnostic data while the vehicle is in motion to determine if the status of the incomplete vehicle monitoring process transitions to complete.

The method may include displaying, on a display screen, a driving procedure associated with the incomplete vehicle monitor.

The portable electronic device used in the establishing step may be a diagnostic dongle, and the communication link may be established by connecting the diagnostic dongle to a diagnostic port on the vehicle. The display screen used in the displaying step may be implemented on a handheld communication device or on a handheld diagnostic scan tool.

The method may further comprise the step of accessing a conditions database and identifying a pre-condition associated with the driving procedure. The method may additionally include receiving live data from the vehicle computer using the portable electronic device and analyzing the live data to determine if the pre-condition is satisfied. The method may comprise the step of displaying the identified pre-condition on the display screen.

The method may also include the step of displaying, on a display screen while the vehicle is in motion, information regarding the tracked progression of the vehicle through the driving procedure. The driving procedure may include at least one driving parameter, the method further comprising the step of displaying the at least one driving parameter on a display screen while the vehicle is in motion. The method may further include the steps of: comparing the received live data to the at least one driving parameter while the vehicle is in motion to determine if the received live data meets the at least one driving parameter; and providing an alert on the display screen while the vehicle is in motion when the received live data does not meet the at least one driving parameter.

The step of analyzing the initial diagnostic data may include identifying a complete vehicle monitor, and the method may further include the step of displaying the complete vehicle monitor on the display screen.

According to another aspect of the present disclosure, there is provided a diagnostic system for use with a handheld electronic device and a vehicle having a vehicle computer to complete an incomplete drive cycle test on the vehicle resulting from an incomplete vehicle monitoring process for testing the operation of a vehicle operating system. The diagnostic system includes computer readable instructions downloadable onto the handheld electronic device for configuring the handheld electronic device to: receive initial diagnostic data from the vehicle computer at the handheld electronic device; receive live data from the vehicle computer at the handheld electronic device while the vehicle is in motion to track progression of the vehicle through a driving procedure associated with the incomplete drive cycle test; receive subsequent diagnostic data from the vehicle computer at the handheld electronic device while the vehicle is in motion; and analyze the subsequent diagnostic data while the vehicle is in motion to determine if the status of the incomplete vehicle monitoring process transitions to complete.

The computer readable instructions may further configure the handheld electronic device to analyze the initial diagnostic data to identify the incomplete vehicle monitoring process and the driving procedure associated with completing the incomplete vehicle monitor.

The computer readable instructions may further configure the handheld electronic device to display the driving procedure associated with the incomplete vehicle monitoring process.

The computer readable instructions may further configure the handheld electronic device to display, while the vehicle is in motion, information regarding the tracked progression of the vehicle through the driving procedure.

The computer readable instructions may further configure the handheld electronic device to access a conditions database and identifying a pre-condition associated with the driving procedure.

The driving procedure may include at least one driving parameter, wherein the computer readable instructions may further configure the handheld electronic device to display the at least one driving parameter on a display screen while the vehicle is in motion. The computer readable instructions may further configure the handheld electronic device to: compare the received live data to the at least one driving parameter while the vehicle is in motion to determine if the received live data meets the at least one driving parameter; and provide an alert on the display screen while the vehicle is in motion when the received live data does not meet the at least one driving parameter.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
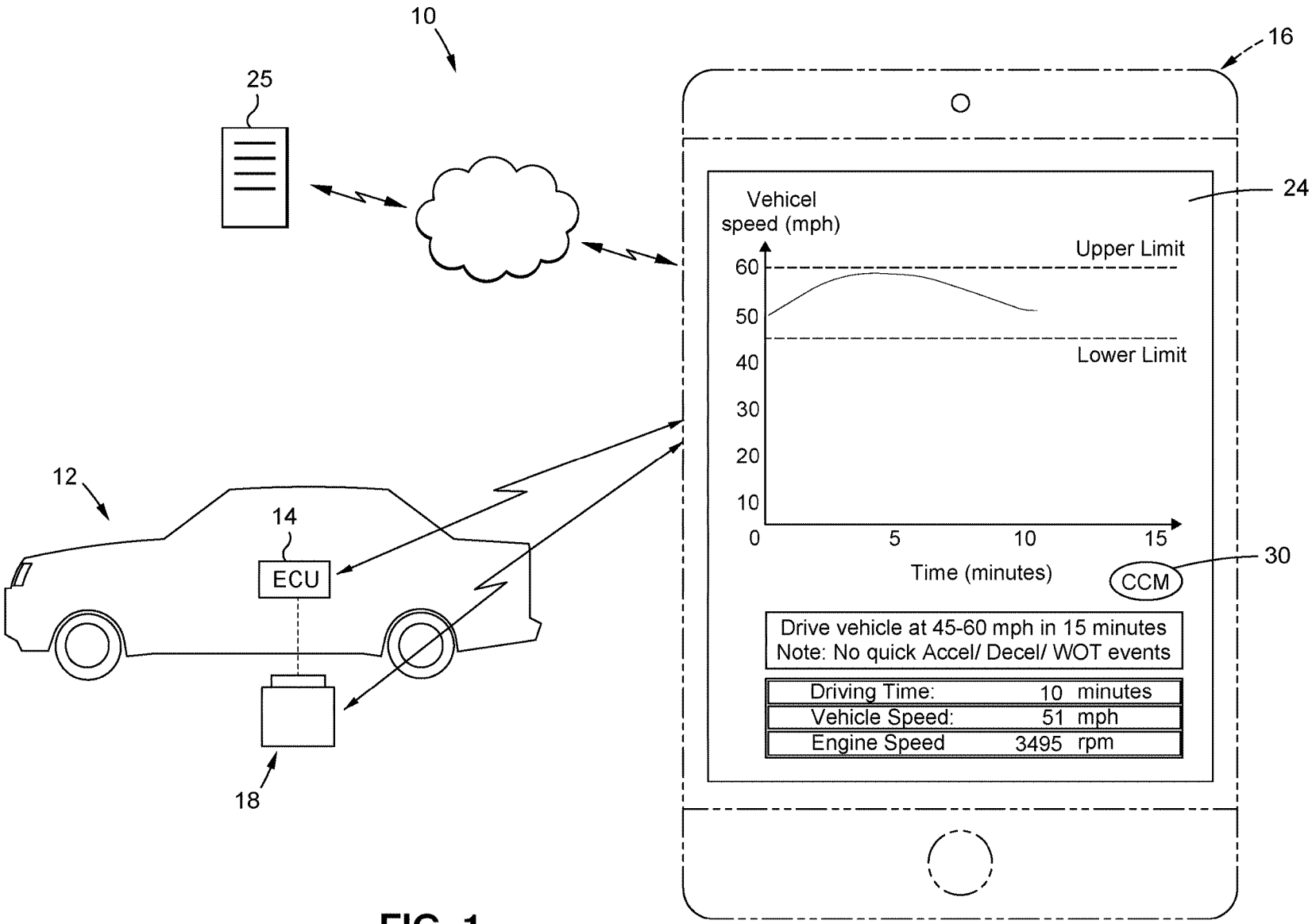
FIG. 1 is a schematic diagram of a system for providing information to a user for completing an incomplete drive cycle test on a vehicle.

Referring now to the drawings wherein the showings are for purposes of illustrating a preferred embodiment of the present disclosure, and are not for purposes of limiting the same, there is depicted a system 10 for assisting a user in completing an incomplete drive cycle test on a vehicle 12. The system 10 is capable of communicating with an electronic control unit (ECU) 14 on the vehicle 12 to receive diagnostic data from the vehicle 12. The diagnostic data may be analyzed to identify one or more incomplete vehicle monitors on the vehicle 12. Once the incomplete vehicle monitors are identified, a driving procedure(s), e.g., a drive cycle, required for completing the incomplete vehicle monitor(s) may be identified through the use of a vehicle monitor database having incomplete vehicle monitors matched with driving procedures. The details of the driving procedure, e.g., step-by-step instructions, may be displayed on a user's smartphone, scan tool, or other digital display, to allow the user to easily view the driving procedure. The system 10 may track the user's progression through the driving procedure and provide a visual and/or audible progress signal to the user to guide the user through the course of the driving procedure. When the driving procedure is complete an alert may be generated to inform the user that the status of the vehicle monitor has transitioned from incomplete to complete.

The system 10 provides the user with the ability to easily identify incomplete vehicle monitors on the vehicle 12, as well as step-by-step instructions for completing the incomplete vehicle monitors. By completing all of the vehicle monitors, the vehicle's onboard diagnostic system can be reset and ready for further diagnostic testing to enhance the safety and operating efficiency of the vehicle 12.

The system 10 utilizes the capabilities of a portable electronic device 16, which may include a smartphone, tablet computer, scan tool, code reader, smartwatch, laptop computer or other portable electronic devices known in the art. The portable electronic device 16 may include software loaded thereon, or alternatively, the software may be downloadable onto the portable electronic device 16 via an application (e.g., a smartphone app.) including computer readable instructions or other downloadable file for configuring the portable electronic device 16 to implement functionalities associated with the system 10. It is contemplated that in some embodiments, the portable electronic device 16 may be capable of communicating directly with the ECU 14, while in other embodiments, the portable electronic device 16 may communicate indirectly with the ECU 14, and may rely on an intermediate communication device (e.g., a second portable electronic device) to communicate with the ECU 14. The intermediate communication device may include a diagnostic dongle 18, a scan tool, code reader, adaptor cable, or the like. The intermediate communication device may be plug connectable into a diagnostic port on the vehicle and may communicate with the portable electronic device 16 via wireless or wired communication.

The system 10 is capable of providing information related to the incomplete vehicle monitors based on an analysis of diagnostic data received from the vehicle ECU 14. The term diagnostic data broadly refers to data received from the ECU 14, which may include, but is not limited to a listing of all vehicle monitors supported on the particular vehicle 12, the current status of monitors, live data, PID data, DTCs, vehicle identification information, etc. As to the vehicle monitors, the diagnostic data may identify all of the complete monitors, as well as all of the incomplete monitors.

Figures 2, 3:
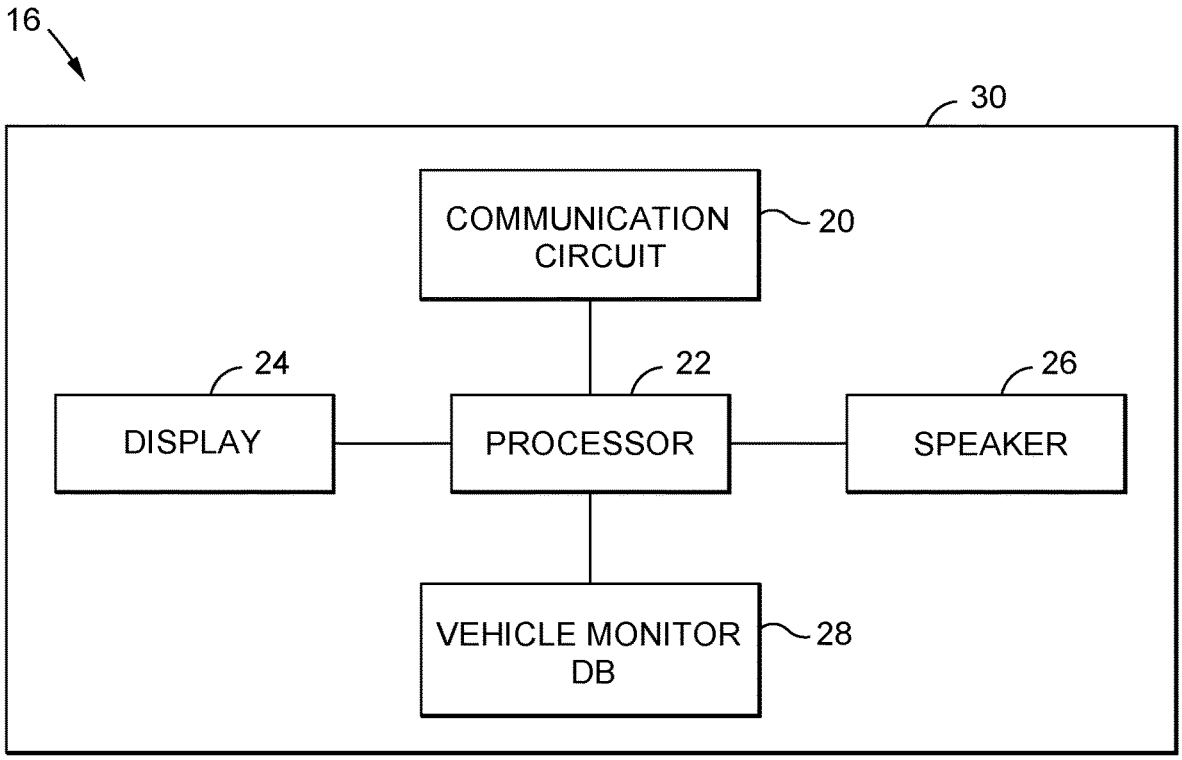
FIG. 2 is a schematic diagram of a handheld electronic device used in the system of FIG. 1.
FIG. 3 is a vehicle monitor database used in the system of FIG. 1.
Figure 4A:
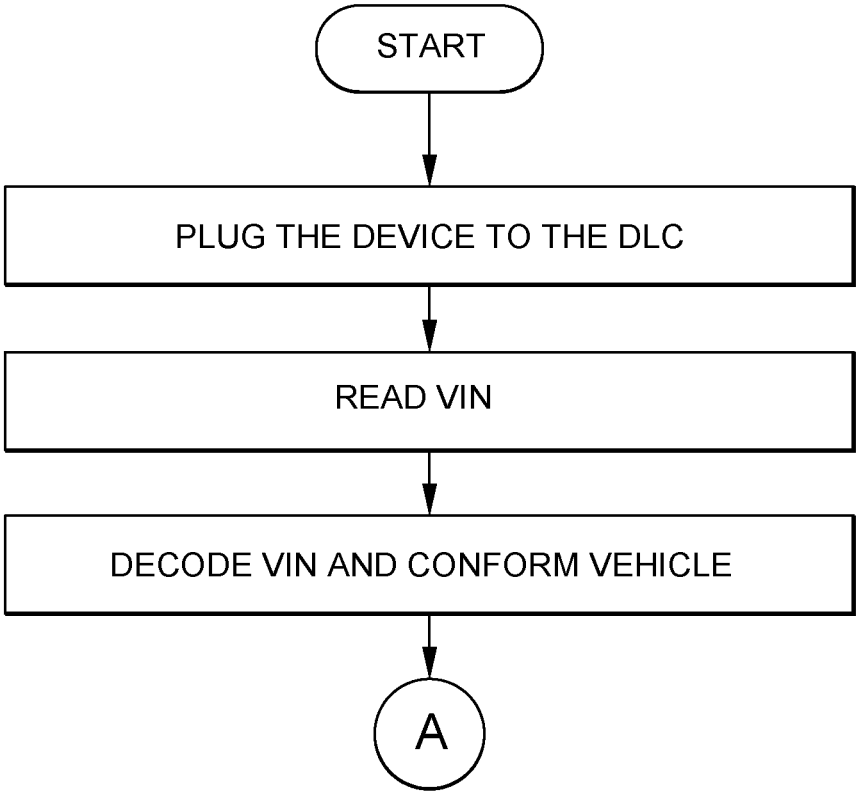
FIGS. 4A-D provide a flow chart of an exemplary method for providing information to a user for completing an incomplete drive cycle test on a vehicle.
Figure 4B:
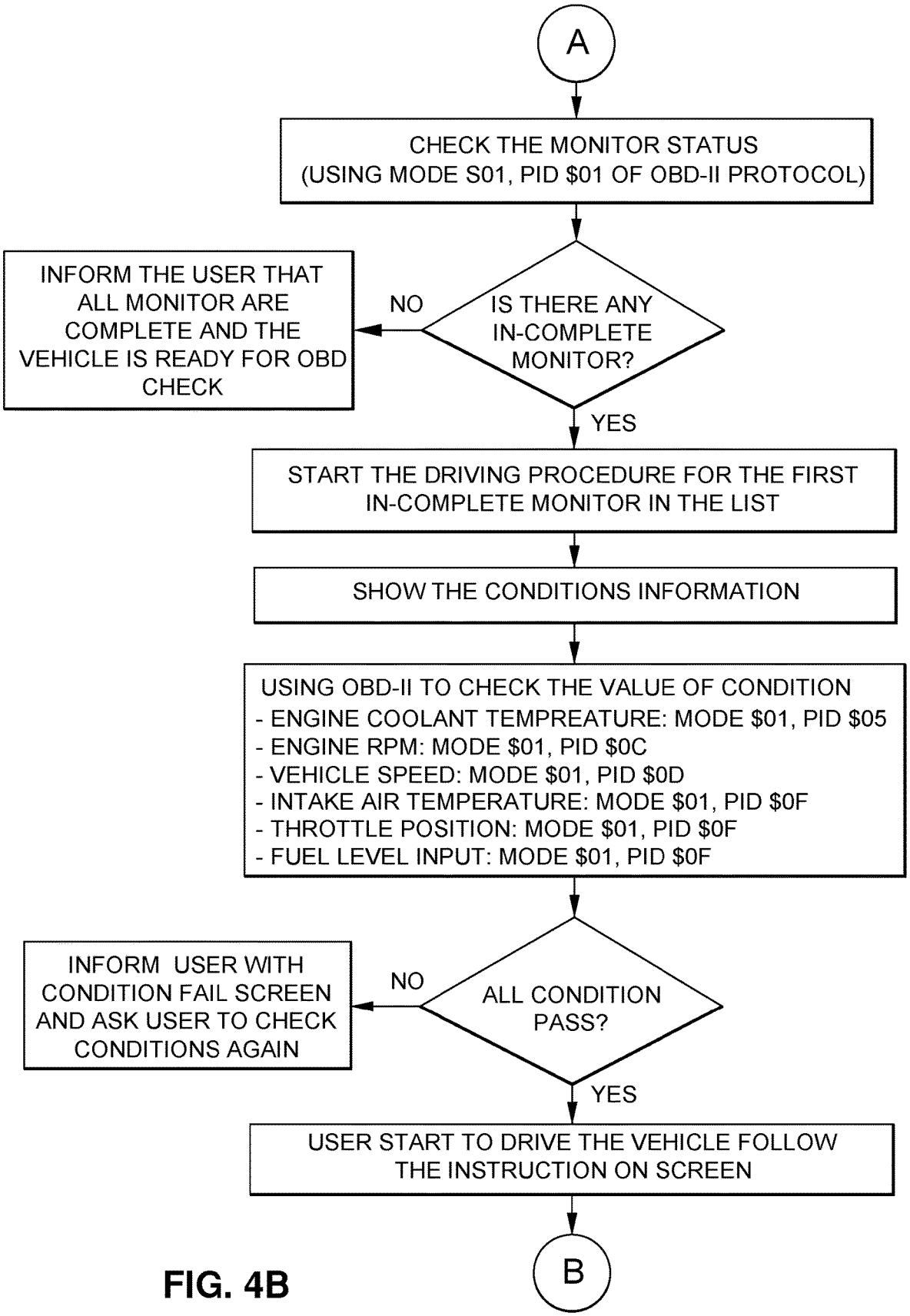
Figure 4C:
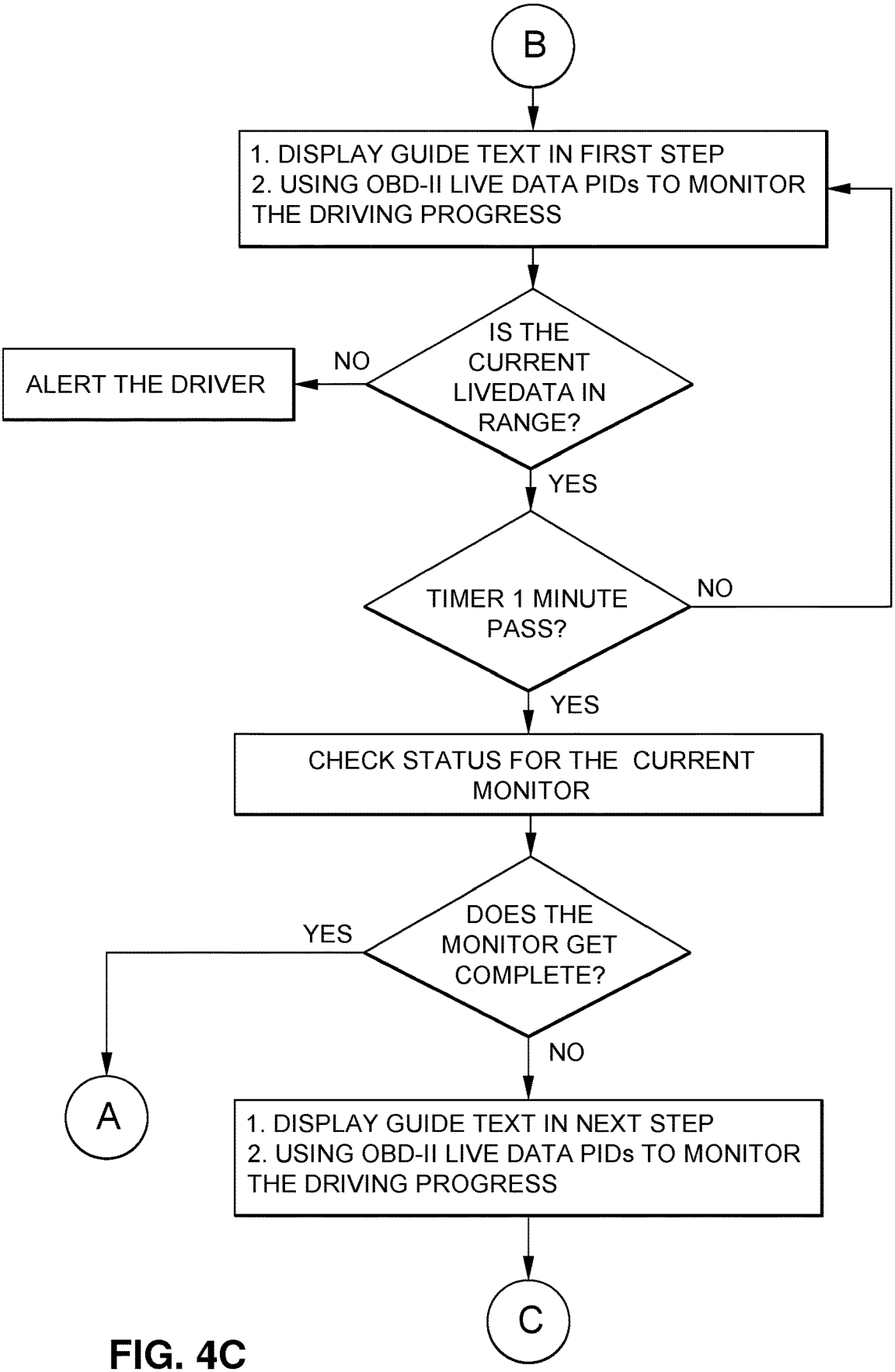
Figure 4D:
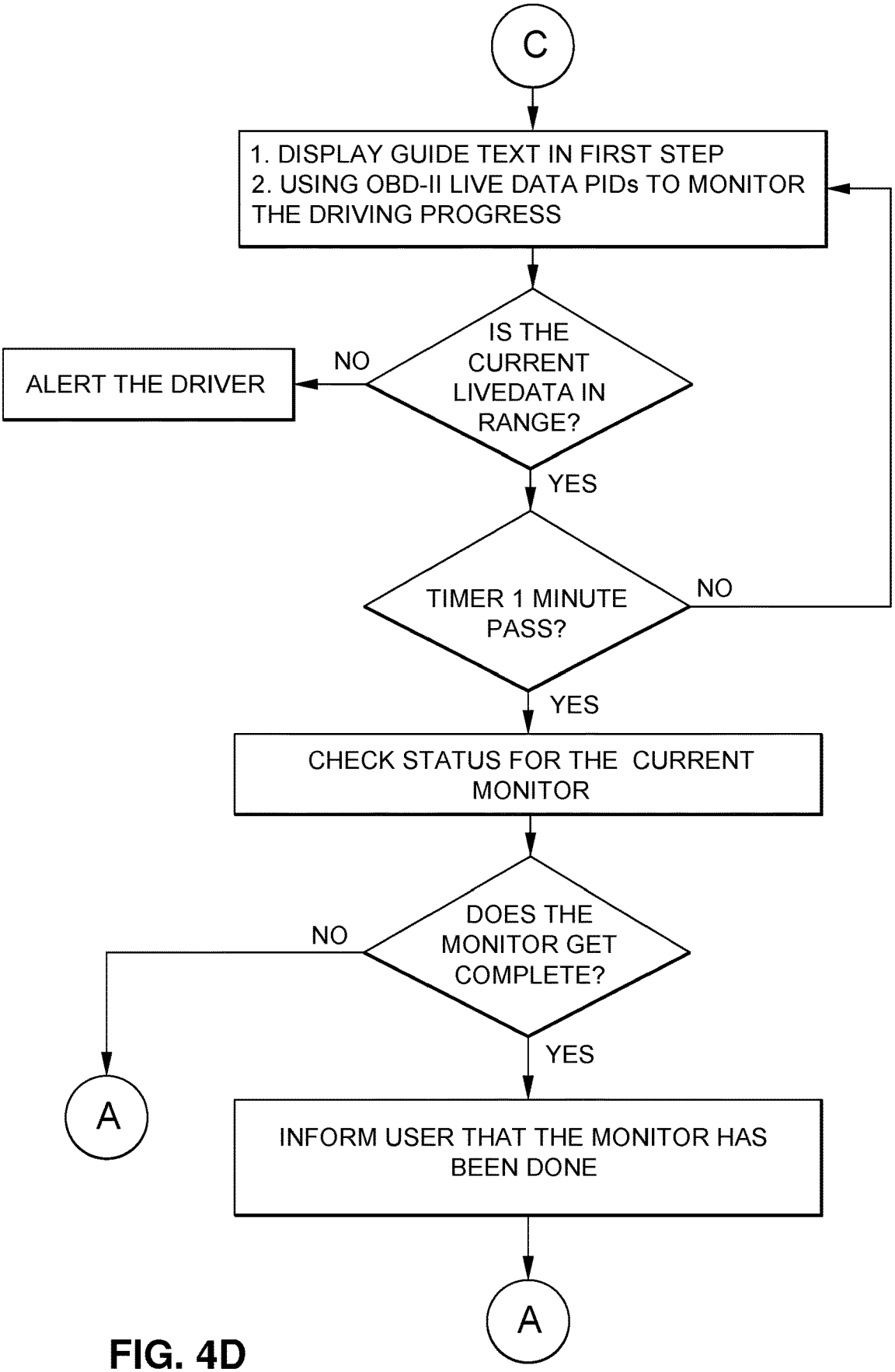

Referring now to FIG. 2, there is depicted a schematic view of the portable electronic device 16, which generally includes a communication circuit 20, a processor 22, a display 24, a speaker 26, and a vehicle monitor database 28, all of which are integrated into a housing 30. The communication circuit 20 may facilitate receipt of the diagnostic data. In this respect, the communication circuit 20 may communicate directly with the vehicle ECU 14, or alternatively, may communicate with the dongle 18 or other data retrieval device which may retrieve the diagnostic data from the ECU 14 and upload the diagnostic data to the portable electronic device 16. The communication circuit 20 may also facilitate upload of the diagnostic data to a remote server 25 or other remote location, for further processing. The communication circuit 20 may facilitate short range communications via BLUETOOTH™, WiFi™, or other short-range communication protocols, while long-range communications may be effectuated via a cellular communications network, the Internet, or other long-range communication networks. The communication circuit 20 may also allow for wired communication between the portable electronic device 16 and an intermediate communication device.

The processor 22 is in communication with the communication circuit 20, the display 24, the speaker 26, and the vehicle monitor database 28. The processor may be a general purpose processor known in the art for implementing the functionalities described herein.

The display 24 may display data, information, graphics, maps, lists, steps, visual alerts, etc. associated with the vehicle monitors and the associated driving procedures and preconditions. The display 24 may be a touch-screen display screen or a display screen without touch-sensitive capabilities.

The speaker 26 may be capable of providing audible status updates and alerts regarding the vehicle monitors. In this regard, the speaker 26 may provide a recitation of the incomplete monitors, and/or the complete monitors. The speaker 26 may also provide step-by-step instructions for completing a driving procedure associated with an incomplete vehicle monitor.

FIG. 3 is an example of the vehicle monitor database 28, which includes a listing of vehicle monitors matched with its corresponding driving procedure, as well as any precondition that may be required before starting the driving procedure. Although FIG. 2 shows the vehicle monitor database 28 located on the portable electronic device 16, in other embodiments, the vehicle monitor database 28 may be located remote from the portable electronic device 16, and accessible through the communication capabilities of the portable electronic device 16. For instance, the vehicle monitor database 28 may be in a remote server 25 which may receive and analyze the diagnostic data, identify one or more incomplete monitors and the corresponding driving procedures. Those results may then be communicated to the portable electronic device 16 for display.

With the basic structure of the system 10 described above, the following discussion, as well as the flow charts depicted in FIGS. 4A-D, relates to an exemplary use of the system 10. A user may open an app. on the portable electronic device 16 and initiate the process of identifying any incomplete vehicle monitors or the related incomplete vehicle monitoring process(es) for testing the operation of a vehicle operating system. The initiation process may entail a manual entry or verbal command detected by the portable electronic device 16. Once the process has been initiated, the portable electronic device 16 may establish communication with the ECU 14, either directly, or via the dongle 18, and send a request to the ECU 14 for diagnostic data. The request may be generated by the processor 22 and transmitted by the communication circuit 20. The ECU 14 may receive the request and send the requested diagnostic data to the portable electronic device 16.

The diagnostic data may be analyzed at the portable electronic device 16 to identify the incomplete vehicle monitors. The identification of the incomplete monitors may be accomplished by using service $01 (Mode $01, PID 01) to check all monitors supported on the vehicle 12 and to read out a list of incomplete monitors. The monitors on the vehicle 12 may include continuous monitors, such as a misfire monitor, a fuel system monitor, and a comprehensive component monitor, as well as non-continuous monitors, such as a catalyst monitor, a heated catalyst monitor, an EVAP system monitor, a secondary air system monitor, an air conditioning monitor, an oxygen sensor monitor, an oxygen sensor heater monitor, a catalyst monitor, and an EGR system monitor. The diagnostic data may also provide an indication if all of the monitors are complete.

The vehicle identification information, which may be included in the diagnostic data, may include an electronic vehicle identification number, or other information identifying the year, make, model, and/or engine of the vehicle 12. The vehicle identification information may be used to obtain additional information about the vehicle 12 under test, such as vehicle specific driving procedures needed for resetting an incomplete vehicle monitor, or vehicle specific preconditions associated with one or more vehicle monitors, as will be described in more detail below. In this regard, the vehicle identification information may be used to obtain or download a vehicle specific vehicle monitor database 28 on the portable electronic device 16.

Once the diagnostic data is received and processed to determine the incomplete vehicle monitors, the vehicle monitor database 28 may be referenced to identify the driving procedure(s) for resetting the incomplete vehicle monitor(s), as well as any preconditions that may be required before the driving procedure can commence. Any preconditions that may be associated with a required driving procedure may be displayed on the display 24. If the driving procedure requires one or more preconditions, the diagnostic data may be checked to ensure all preconditions are met before starting the driving procedure. In one embodiment, the processor 22 may generate a request to check the OBD-II live data PIDs to check whether the preconditions have been met. If the OBD-II live data PIDs reveals that the precondition(s) have not been met, the processor 22 may generate a visual alert for presentation on the display 24 or an audible alert for broadcasting over the speaker 26. Once all of the precondition(s) have been met, a signal or alert may be displayed or broadcast by the portable electronic device 16.

The driving procedure associated with the incomplete vehicle monitor may be displayed on the display screen 24 for viewing by the user. The driving procedure may be displayed on the in step-by-step instructions, and any OBD-II parameters associated with each step may be displayed to guide the user through the driving procedure.

With the driving procedure displayed on the portable electronic device 16, the user may begin driving in accordance with the steps outlined on the display 24. While the vehicle 12 is driven, diagnostic data may be requested from the ECU 14, such as live data, and received at the processor 22. The processor 22 may compare the received live data with the parameters associated with the driving procedure to make sure the user is satisfying the driving procedure.

The system 10 may further be capable of displaying, on the display screen 24 while the vehicle 12 is in motion, information regarding the tracked progression of the vehicle 12 through the driving procedure. In this regard, the display screen 24 may display, while the vehicle is in motion, at least one driving parameter associated with the driving procedure, as well as performance data during the driving procedure. An alert may be provided on the display screen 24 while the vehicle 12 is in motion when the received live data does not meet the required driving parameter(s).

Referring to the display 24 on the portable electronic device 16 depicted in FIG. 1, the driving procedure depicted thereon requires the vehicle 12 to be driven between 45 mph and 60 mph continuously for 15 minutes. Accordingly, the driving procedure includes two speed parameters, namely an upper threshold parameter of 60 mph and a lower threshold parameter of 45 mph, as well as a time parameter, namely 15 minutes. These parameters may be retrieved from the vehicle monitor database 28 once the incomplete vehicle monitor is identified.

During the driving procedure, a status request may be sent from the portable electronic device 16 to the ECU 14 to check the real-time vehicle monitor status. An icon 30 (see FIG. 1) may be displayed on the display 24 to provide a real-time visual of the status of the vehicle monitors, wherein the icon changes when the vehicle monitor status transitions from incomplete to complete. For instance, the icon 30 may be associated with one color, e.g., red, when the vehicle monitor status is incomplete, and another color, e.g., green, when the vehicle monitor status is complete. In other embodiments, the icon may include an X, which may transition to a checkmark. Other changes in the icon known in the art may also be used without departing from the spirit and scope of the present disclosure.

When the vehicle monitor associated with a current driving procedure is complete, all monitor status will be checked again, and the process may restart with any additional vehicle monitors that may be incomplete.

As described above, the system 10 and related methodology allows a user to easily retrieve data from the vehicle 12 to identify and display any incomplete vehicle monitors as well as the corresponding driving procedures for completing the vehicle monitors. Once the user initiates the process, the steps of retrieving data, analyzing data, and displaying information may proceed autonomously without user input. Furthermore, the personalization of the system 10 based on vehicle identification information received from the vehicle 12 may also be accomplished autonomously without user input.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A method of completing an incomplete drive cycle test on a vehicle resulting from an incomplete vehicle monitoring process for testing the operation of a vehicle operating system, the method comprising the steps of:

establishing a communication link between a portable electronic device and a vehicle computer;

receiving initial diagnostic data from the vehicle computer using the portable electronic device;

analyzing the initial diagnostic data to identify the incomplete vehicle monitoring process and a driving procedure for resetting an incomplete vehicle monitor associated with the incomplete vehicle monitoring process;

receiving live data from the vehicle computer while the vehicle is in motion using the portable electronic device to track progression of the vehicle through the driving procedure;

receiving subsequent diagnostic data from the vehicle computer while the vehicle is in motion using the portable electronic device; and analyzing the subsequent diagnostic data while the vehicle is in motion to determine whether the status of the incomplete vehicle monitoring process has transitioned to complete.

2. The method recited in claim 1, further comprising the step of displaying, on a display screen, a driving procedure associated with the incomplete vehicle monitor.

3. The method recited in claim 2, wherein the portable electronic device used in the establishing step is a diagnostic dongle, the communication link being established by connecting the diagnostic dongle to a diagnostic port on the vehicle.

4. The method recited in claim 3, wherein the display screen used in the displaying step is implemented on a handheld communication device.

5. The method recited in claim 3, wherein the display screen used in the displaying step is implemented on a handheld diagnostic scan tool.

6. The method recited in claim 1, further comprising the step of displaying, on a display screen while the vehicle is in motion, information regarding the tracked progression of the vehicle through the driving procedure.

7. The method recited in claim 1, further comprising the step of accessing a conditions database and identifying a pre-condition associated with the driving procedure.

8. The method recited in claim 7, receiving live data from the vehicle computer using the portable electronic device and analyzing the live data to determine if the pre-condition is satisfied.

9. The method recited in claim 7, further comprising the step of displaying the identified pre-condition on the display screen.

10. The method recited in claim 1, wherein the driving procedure includes at least one driving parameter, the method further comprising the step of displaying the at least one driving parameter on a display screen while the vehicle is in motion.

11. The method recited in claim 10, further comprising the steps of:

comparing the received live data to the at least one driving parameter while the vehicle is in motion to determine if the received live data meets the at least one driving parameter; and providing an alert on the display screen while the vehicle is in motion when the received live data does not meet the at least one driving parameter.

12. The method recited in claim 1, wherein the step of analyzing the initial diagnostic data includes identifying a complete vehicle monitor, the method further comprising the step of displaying the complete vehicle monitor on the display screen.

13. A diagnostic system for use with a handheld electronic device and a vehicle having a vehicle computer to complete an incomplete drive cycle test on the vehicle resulting from an incomplete vehicle monitoring process for testing the operation of a vehicle operating system, the diagnostic system comprising:

computer readable instructions downloadable onto the handheld electronic device for configuring the handheld electronic device to:

receive initial diagnostic data from the vehicle computer at the handheld electronic device;

receive live data from the vehicle computer at the handheld electronic device while the vehicle is in motion to track progression of the vehicle through a driving procedure associated with the incomplete drive cycle test;

receive subsequent diagnostic data from the vehicle computer at the handheld electronic device while the vehicle is in motion; and analyze the subsequent diagnostic data while the vehicle is in motion to determine whether the status of the incomplete vehicle monitoring process has transitioned to complete.

14. The system recited in claim 13, wherein the computer readable instructions further configure the handheld electronic device to analyze the initial diagnostic data to identify the incomplete vehicle monitoring process and the driving procedure associated with completing the incomplete vehicle monitor process.

15. The system recited in claim 13, wherein the computer readable instructions further configure the handheld electronic device to display the driving procedure associated with the incomplete vehicle monitoring process.

16. The system recited in claim 13, wherein the computer readable instructions further configure the handheld electronic device to display, while the vehicle is in motion, information regarding the tracked progression of the vehicle through the driving procedure.

17. The method recited in claim 13, wherein the computer readable instructions further configure the handheld electronic device to access a conditions database and identifying a pre-condition associated with the driving procedure.

18. The system recited in claim 13, wherein the driving procedure includes at least one driving parameter, wherein the computer readable instructions further configure the handheld electronic device to display the at least one driving parameter on a display screen while the vehicle is in motion.

19. The system recited in claim 18, wherein the computer readable instructions further configure the handheld electronic device to:

compare the received live data to the at least one driving parameter while the vehicle is in motion to determine if the received live data meets the at least one driving parameter; and provide an alert on the display screen while the vehicle is in motion when the received live data does not meet the at least one driving parameter.

20. The system recited in claim 13, wherein the step of analyzing the initial diagnostic data includes identifying a complete vehicle monitor, wherein the computer readable instructions further configure the handheld electronic device to display the complete vehicle monitor on the display screen.

* * * * *